United States Patent [19]

Wood et al.

[11] 4,139,031

[45] Feb. 13, 1979

[54] AUTOMATIC SHUT-OFF NOZZLE HAVING CONTROLLED VENTURI

[75] Inventors: Chester W. Wood, Milford; Robert W. Guertin, Cincinnati, both of Ohio

[73] Assignee: Dover Corporation, New York, N.Y.

[21] Appl. No.: 781,122

[22] Filed: Mar. 25, 1977

[51] Int. Cl.[2] ..... B65B 57/14

[52] U.S. Cl. ..... 141/206

[58] Field of Search ..... 141/198, 46, 206–229, 141/285, 392

[56] References Cited

U.S. PATENT DOCUMENTS 3,521,681 7/1970 Wilson ..... 141/209

*Primary Examiner*—Richard E. Aegerter
*Assistant Examiner*—Frederick R. Schmidt
*Attorney, Agent, or Firm*—John G. Schenk

[57] ABSTRACT

An automatic shut-off nozzle has a venturi effect, which causes automatic shut off of the liquid flow through the nozzle body by causing a main poppet valve to be closed when the tank is filled, created by two aligned passages of different diameters in either the resiliently biased bleeder poppet valve, which opens in response to the pressure of the fluid flowing through the nozzle body, or the seat ring for the bleeder poppet valve. The smaller diameter passage has the liquid enter its inlet with the liquid exiting through the outlet of the larger diameter passage with the larger diameter passage also communicating with the vacuum chamber in which the vacuum is increased by the venturi when the tank is filled to cause automatic closing of the main poppet valve in the nozzle body.

10 Claims, 8 Drawing Figures

AUTOMATIC SHUT-OFF NOZZLE HAVING CONTROLLED VENTURI

When filling a vehicle tank with gasoline through a dispensing nozzle, vapors from the gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be recovered through vapor recovery equipment utilized in conjunction with the nozzle.

However, the level of the gasoline within the vehicle tank being filled cannot be viewed because of the sealing of the fill pipe opening. Therefore, it is necessary for there to be automatic shut off of the supply of gasoline with a nozzle having a vapor recovery arrangement.

The automatic shut-off mechanism, which automatically stops the supply of gasoline to the vehicle tank, depends upon the level of the liquid in the tank reaching a predetermined level at which it blocks a vacuum passage opening in the nozzle spout to cause activation of release means to move the main poppet valve, which is controlling liquid flow from the inlet of the nozzle body through the body, to its closed position. With a very low flow rate through the nozzle body such as less than 1½ gallons per minute, the blocking of the vacuum passage opening in the nozzle spout does not necessarily result in automatic shut off of the flow of gasoline through the nozzle body. This is because the venturi effect has been produced by cooperation of the bleeder poppet valve, which is resiliently biased toward its closed position, with a shoulder on the seat ring for the bleeder poppet valve. This arrangement produces a varying passage area therebetween depending on the pressure of the gasoline. At a relatively low flow rate, the pressure of the gasoline may hold the bleeder poppet valve sufficiently removed from the shoulder of the seat rings to provide an area therebetween that is not completely filled by the gasoline because of the low flow rate. As a result, air can be withdrawn from the tank through the spout by the venturi rather than from the vacuum chamber to prevent the increase of the partial vacuum in the vacuum chamber even when the vacuum passage opening in the nozzle spout is blocked. When this occurs, the blocking of the vacuum passage opening in the nozzle spout by the gasoline level in the tank being filled does not cause the required partial vacuum increase in the vacuum chamber for actuating the release means to move the main poppet valve to its closed position. Instead, air is withdrawn from the tank through the spout rather than from the vacuum chamber.

Accordingly, if an attendant pumps the gasoline at a very low rate through the spout into the tank, automatic shut off would not occur, and the gasoline would be pumped through the fill pipe to the tank and then returned to the vapor recovery equipment through the vapor return passage. As a result, the customer would pay for gasoline not received since the pumping of the gasoline is utilized to determine the quantity supplied to the customer. Therefore, by pumping at a very low rate, an attendant can deceive a customer into paying for gasoline not received permanently in the tank of the customer when the nozzle has a vapor recovery arrangement.

The present invention satisfactorily solves the foregoing problem through providing a venturi arrangement in which an increase in vacuum is produced in the vacuum chamber whenever the vacuum passage opening in the nozzle spout is blocked. Thus, the venturi construction of the present invention insures that there is automatic shut off irrespective of the flow rate through the nozzle body. The present invention is capable of stopping flow through the nozzle when the flow rate is as low as one-quarter gallon per minute.

The present invention accomplishes this through providing a fixed flow area for the gasoline through either the seat ring or the bleeder poppet valve. By designing the flow area to have a relatively small area, the desired venturi effect can be obtained with a minimum flow rate of one-quarter to one-half gallon per minute.

This relatively small flow area of the venturi prevents air from being sucked from the tank through the spout when there is a relatively low flow rate and the vacuum passage opening in the nozzle spout is blocked. This is because the relatively small flow area is such that it is continuously filled with gasoline at the minimum flow rate at which the gasoline flows through the nozzle body.

When using an automatic shut-off nozzle without a vapor recovery arrangement, the attendant usually sets the flow rate at the minimum while performing other duties such as checking the oil level of the engine, for example. At this low flow rate, there have been occasions when the automatic shut-off mechanism has not functioned because of the capability of drawing air from the tank through the spout because of the relatively large flow area between the bleeder poppet valve and its seat ring. That is, a film of gasoline does not fill the entire area but leaves spaces therebetween so that air can be sucked into these spaces from the tank through the spout.

When this occurs, the tank being filled overflows so that gasoline is spilled onto the pavement. While the customer is not charged for this, the presence of the gasoline on the customer's car and the pavement can create a hazard.

The use of the venturi construction of the present invention eliminates this hazard. Thus, the attendant does not have to worry about possible overflow of the tank at a low flow rate when using an automatic shut-off nozzle having the venturi construction of the present invention.

An object of this invention is to provide an automatic shut-off nozzle having a controlled venturi area irrespective of the flow rate and pressure of the liquid flowing through the nozzle body.

Another object of this invention is to provide an automatic shut-off nozzle capable of stopping flow automatically at relatively low flow rates of liquid through the nozzle body.

Other objects, uses, and advantages of this invention are apparent upon a reading of this description which proceeds with reference to the drawings forming part thereof and wherein.

Figure 1:
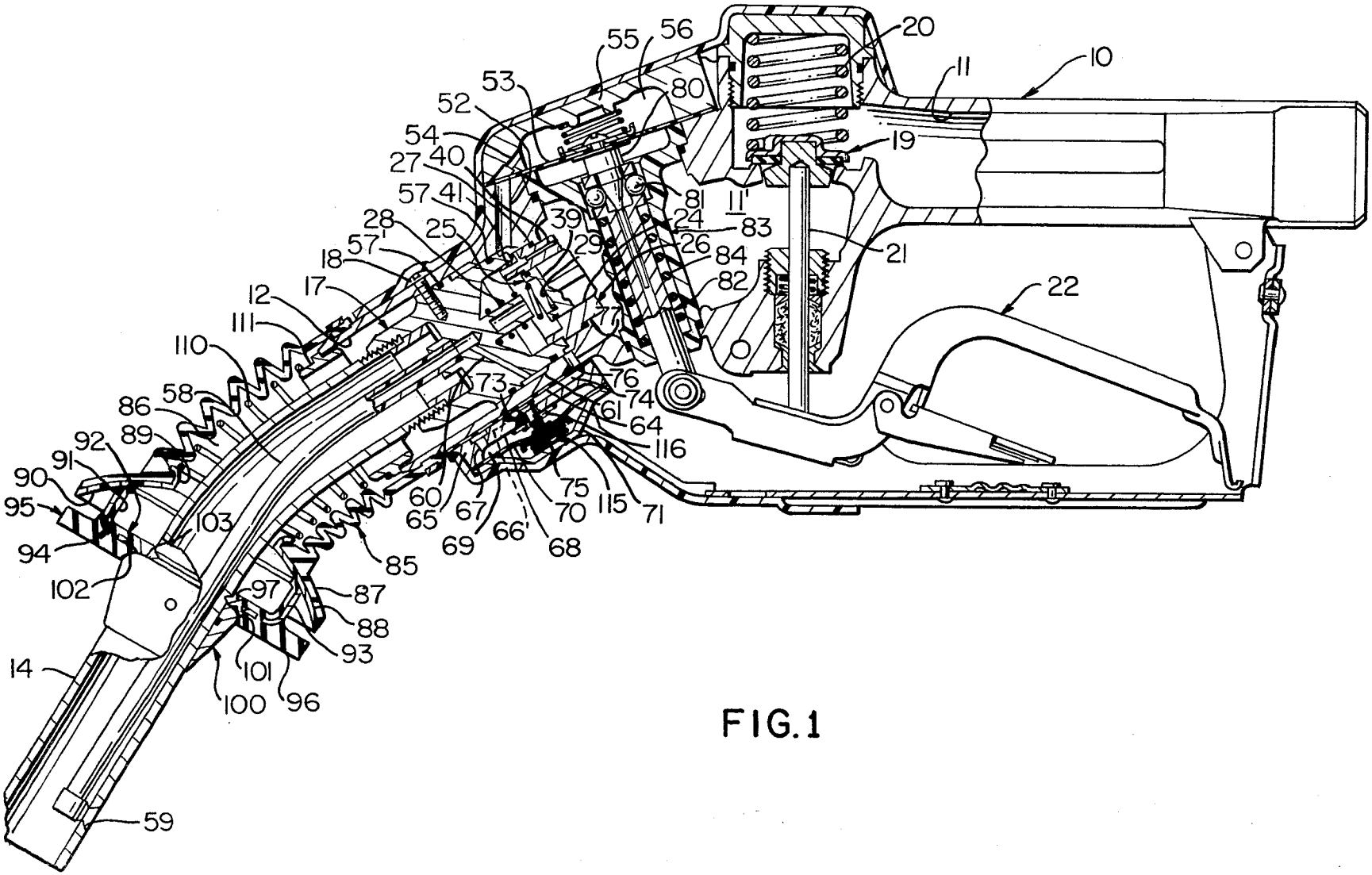
FIG. 1 is a sectional view, partly in elevation, of a nozzle having the venturi construction of the present invention formed in the seat ring for the by-pass valve.
Figure 2:
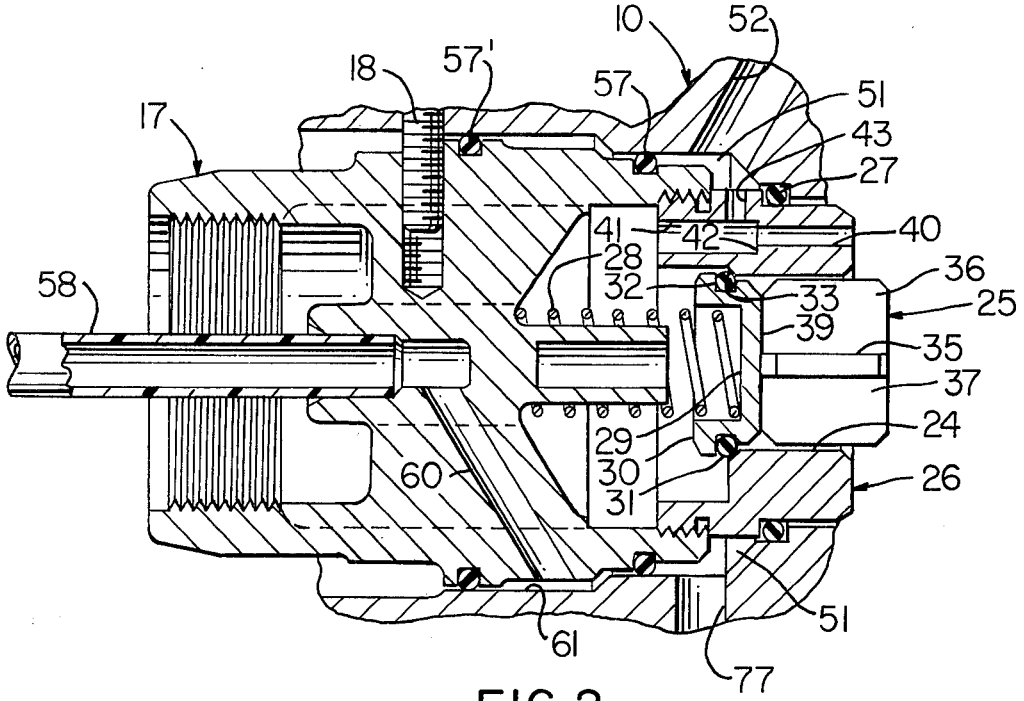
FIG. 2 is an enlarged fragmentary sectional view of a portion of the nozzle of FIG. 1 and showing the by-pass valve in its closed position.
Figure 3:
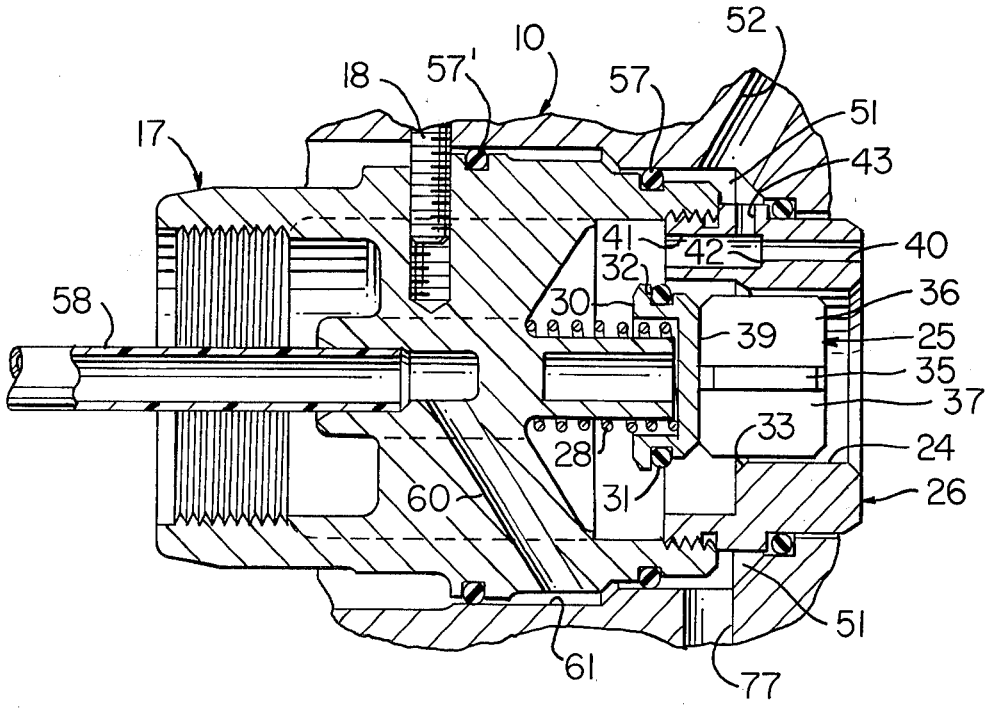
FIG. 3 is an enlarged fragmentary sectional view, similar to FIG. 2, of a portion of the nozzle of FIG. 1 and showing the by-pass valve in its open position in which flow occurs through the nozzle body.
Figure 4:
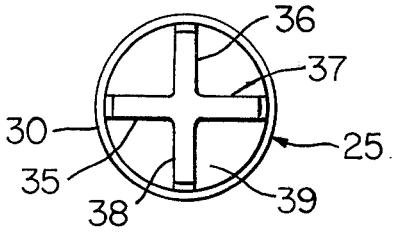

FIG. 4 is an end elevational view of the by-pass valve of FIGS. 1–3.

Figure 5:
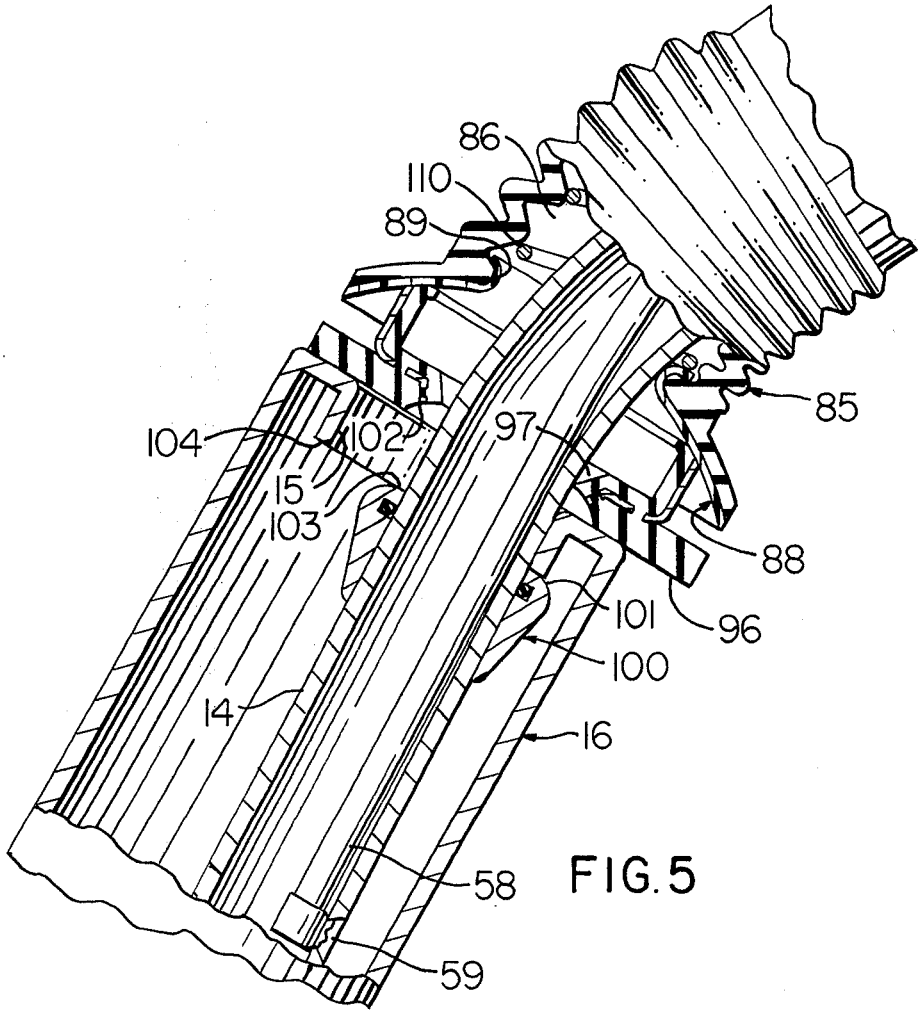

FIG. 5 is a fragmentary sectional view, partly in elevation, of a portion of the nozzle of FIG. 1 and showing the spout in the fill pipe of a vehicle tank with the seal of the vapor return means being effective.

Figure 6:
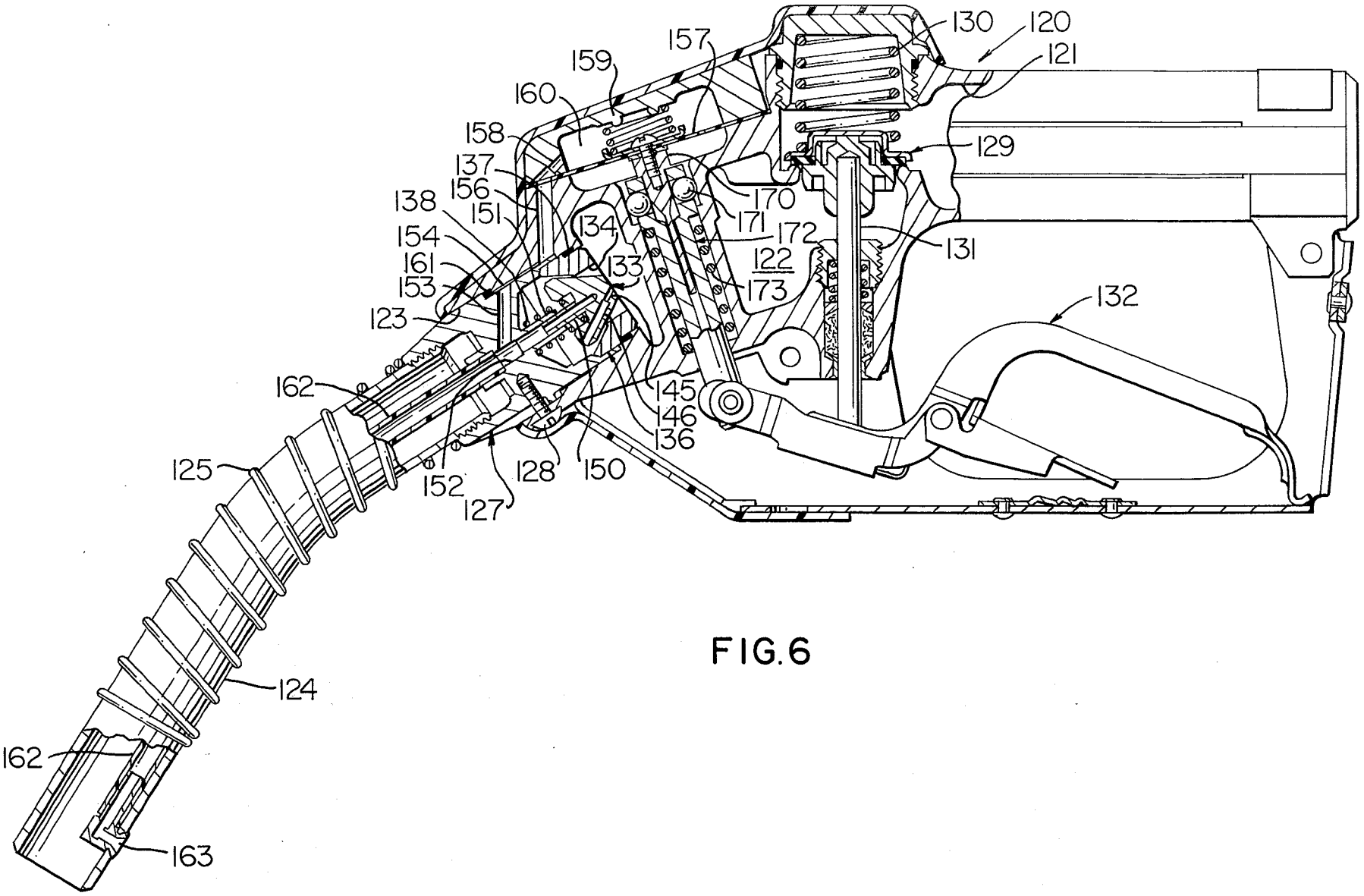

FIG. 6 is a sectional view, partly in elevation, of another nozzle having the venturi construction of the present invention formed in the by-pass valve.

Figure 7:
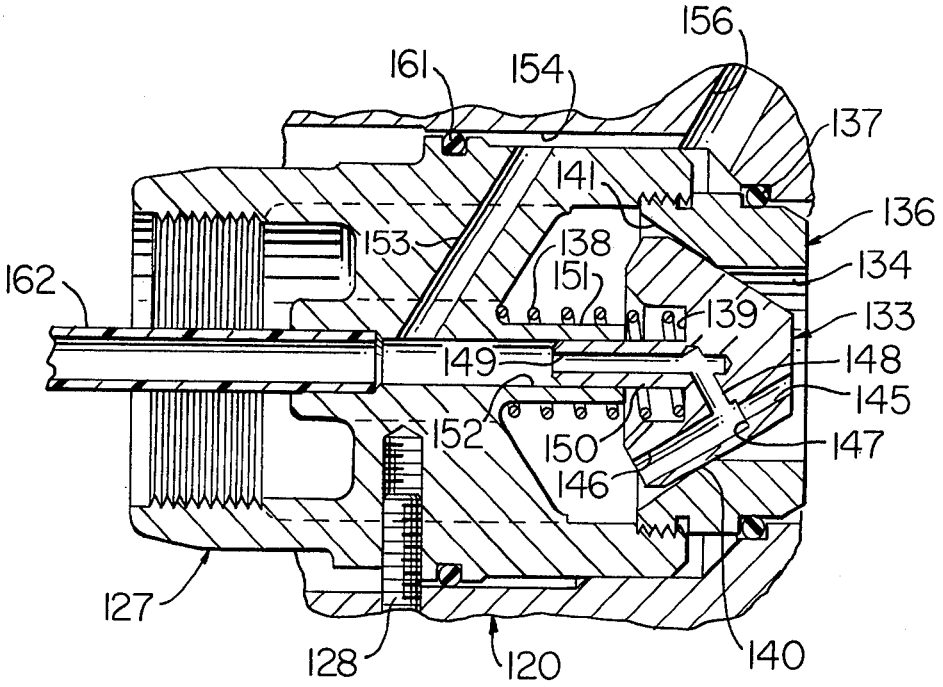

FIG. 7 is an enlarged fragmentary sectional view of a portion of the nozzle of FIG. 6 and showing the by-pass valve in its closed position.

Figure 8:
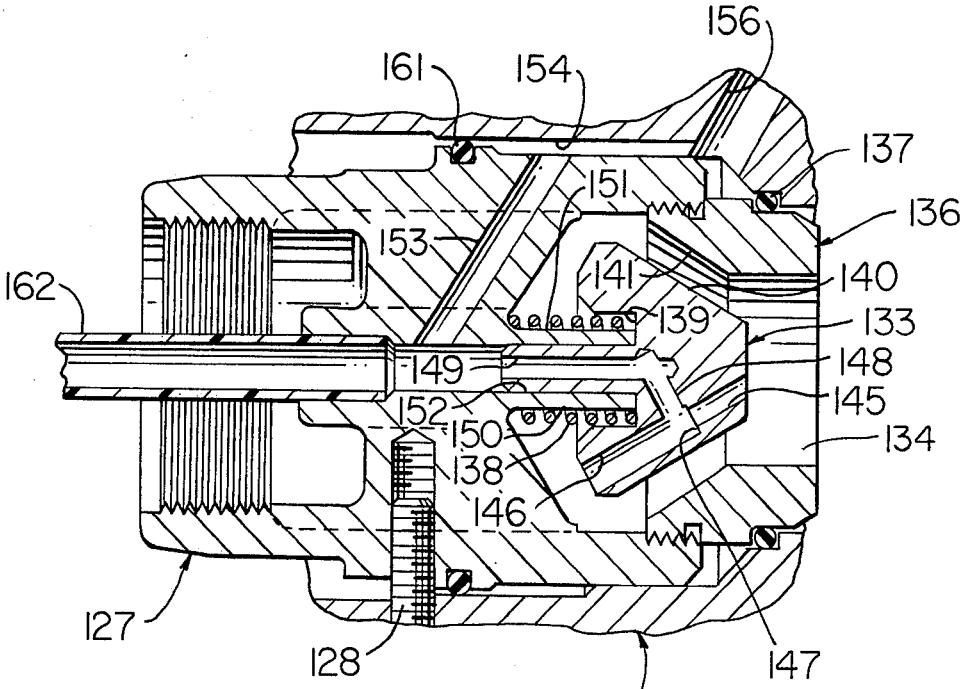

FIG. 8 is an enlarged fragmentary sectional view, similar to FIG. 7, of a portion of the nozzle of FIG. 6 and showing the by-pass valve in its open position in which flow occurs through the nozzle body.

Referring to the drawings and particularly FIG. 1, there is shown a nozzle body 10 having an inlet 11 to which a hose is connected to supply liquid such as gasoline, for example, to a chamber 11′ within the interior of the body 10. The body 10 has an outlet 12 with which a spout 14 communicates to receive liquid from the chamber 11′ within the interior of the body 10.

The spout 14, which is adapted to be inserted within an opening 15 (see FIG. 5) in a fill pipe 16 of a vehicle tank such as an automobile fuel tank, for example, has an end threaded in a spout adapter 17, which is connected to the outlet 12 of the body 10 by a screw 18.

The body 10 has a first or main poppet valve 19 supported therein for control of the flow of liquid from the inlet 11 to the chamber 11′ within the interior of the body 10 and from the chamber 11′ to the outlet 12. A spring 20 continuously urges the poppet valve 19 to its closed position in which flow from the inlet 11 to the chamber 11′ and the outlet 12 is stopped or prevented.

A stem 21 is connected to the poppet valve 19 and has its lower portion extending exteriorly of the body 10. The valve stem 21, which is slidably disposed within the body 10, is moved by a manually operated lever or handle 22. The stem 21 passes through the body 10 in the same manner as described in U.S. Pat. No. 3,811,486 to Wood.

A by-pass or bleeder poppet valve 25 is slidably mounted within a passage 24 in a seat ring 26. The seat ring 26 is secured to the spout adapter 17 by being threadedly connected thereto as shown in FIGS. 2 and 3 and has a sealing ring 27 disposed therebetween to prevent leakage therebetween.

A spring 28, which has one end engaging a portion of the spout adapter 17 and its other end engaging a flat surface 29 of a cup-shaped element 30 of the by-pass valve 25, urges the by-pass valve 25 to the position of FIG. 2 in which an O-ring 31, which is carried in a groove 32 in the cup-shaped element 30 of the by-pass valve 25, engages an angled surface 33 of the seat ring 26 to allow the valve 25 to close the passage 24. Thus, only the pressure of liquid going from the inlet 11 and past the main poppet valve 19 can overcome the spring 28 and move the by-pass valve 25 to an open position (see FIG. 3) in which the sealing ring 31 no longer engages the surface 33 of the seat ring 26.

The cup-shaped element 30 of the by-pass valve 25 has four legs 35–38 (see FIG. 4) extending from a flat surface 39, which is parallel to the surface 29, thereof. The legs 35–38, which are equally angularly spaced from each other, cooperate with the wall of the passage 24 in the seat ring 26 to guide the sliding movement of the by-pass valve 25 in the passage 24.

The seat ring 26 has a first passage 40 having one end communicating with the chamber 11′ within the interior of the body 10 and its other end communicating with one end of a second passage 41 in the seat ring 26. The other end of the second passage 41 communicates with the downstream sides of the seat ring 26 and the by-pass valve 25. The first passage 40 has a smaller diameter than the second passage 41 to form a shoulder 42 at the junction of the first passage 40 and the second passage 41. The seat ring 26 has a third passage 43, which has its axis substantially perpendicular to the axis of the passages 40 and 41 and has a slightly smaller diameter than the first passage 40, communicating with the second passage 41 and an annular chamber 51, which is formed between the body 10, the spout adapter 17, and the seat ring 26.

As the liquid flows through the first passage 40 and the second passage 41, a venturi effect is created in the third passage 43. This is because the increase in the cross sectional area of the second passage 41 compared with the cross sectional area of the first passage 40 produces an expansion of the liquid to reduce its velocity whereby air is drawn from the third passage 43 into the second passage 41. The third passage 43 communicates through the chamber 51, a passage 52 in the body 10, an opening in a diaphragm 53, and a passage 54 in a cap 55 to a chamber 56, which is formed between the diaphragm 53 and the cap 55.

Sealing rings 57 and 57′ are disposed between the spout adapter 17 and the body 10. These prevent air from entering the chamber 51 from exterior of the body 10.

The chamber 51 also communicates with a vacuum tube 58, which is connected with an opening 59 (see FIG. 1) in the spout 14 adjacent the discharge or free end of the spout 14. The tube 58 communicates through a passage 60 (see FIG. 1) in the spout adapter 17 with a chamber 61, which is formed between the sealing rings 57 and 57′, the spout adapter 17, and the body 10. The chamber 61 communicates through a passage (not shown) in the nozzle body 10 and an opening (not shown) in a seal 64, which is disposed between the body 10 and a housing 65 secured to the body 10, to a horseshoe-shaped passage 66 in the housing 65. This is more particularly shown in the copending patent application of Jack A. McMath et al for "Automatic Shut-Off Nozzle Having Vapor Return Seal," Ser. No. 684,441, filed May 7, 1976, refiled as continuation Ser. No. 856,108 filed on Nov. 30, 1977 and assigned to the same assignee as the assignee of this application.

The horseshoe-shaped passage 66 in the housing 65 communicates through a passage 67 in a divider 68 of the housing 65 with a chamber 69, which is formed between the divider 68 and a diaphragm 70. A retainer 71 holds the diaphragm 70 on the housing 65.

The chamber 69 communicates through a passage 73 in the divider 68 of the housing 65 with a chamber 74, which is formed within the housing 65 between the divider 68 and the seal 64. The passage 73 is controlled by a poppet valve 75, which is responsive to the diaphragm 70. The chamber 74 communicates through an opening 76 in the seal 64 and a passage 77 in the body 10 with the annular chamber 51.

Accordingly, as long as the poppet valve 75 is open and the opening 59 is not closed due to the liquid within the tank reaching a predetermined level that indicates that the tank is filled, the venturi effect created by the flow of the liquid through the passages 40 and 41 in the seat ring 26 draws air through the tube 58 to create a partial vacuum within the chamber 56. However, as soon as the opening 59 is blocked or the valve 75 is closed, the chamber 56 has its pressure reduced due to the air therein being drawn therefrom because of the venturi effect in the third passage 43 due to the liquid flowing through the passages 41 and 42 whereby the diaphragm 53 moves upwardly since the partial vacuum in the chamber 53 is increased.

The diaphragm 53 has a latch retaining pin 80 secured thereto for movement therewith and disposed between three balls 81 (two shown) which are positioned within passages in a latch plunger 82. When the latch retaining pin 80 is in the position shown in FIG. 1, the balls 81 prevent downward movement of the plunger 82, which is slidably mounted within an insert 83. The insert 83, which is preferably formed of a plastic, is supported in the body 10.

When the diaphragm 53 is moved upwardly due to the increase in the partial vacuum in the chamber 56, the latch retaining pin 80 is moved upwardly therewith. The upward movement of the retaining pin 80 disposes a tapered portion of the retaining pin 80 between the balls 81 whereby the balls 81 may move inwardly to allow the plunger 82 to be moved downwardly against the force of its spring 84. The correlation between the tapered portion of the pin 80 and the latch plunger 82 is more specifically shown in U.S. Pat. No. 2,582,195 to Duerr.

The lower end of the plunger 82 is connected to the handle 22 as more particularly shown and described in U.S. Pat. No. 3,817,285 to Wilder et al. Thus, when the diaphragm 53 moves upwardly to pull the latch retaining pin 80 and release the latch plunger 82 from the balls 81, the force of the spring 20 closes the main poppet valve 19 as more particularly shown and described in the aforesaid Wilder et al patent.

The body 10 has a bellows 85, which is preferably formed of a gasoline resistant synthetic rubber, secured thereto and extending from the outlet 12 of the body 10 towards the free or discharge end of the spout 14. The bellows 85 is disposed in spaced relation to the spout 14 to form an annular passage 86 therebetween.

The end of the bellows 85 remote from the outlet 12 of the body 10 has a member 87, which is preferably formed integral therewith. The member 87 has a member 88, which is plastic such as Delrin, for example, connected by the member 88 having its curved portion snapped into the bellows 85 and retained therein by the resilience of the bellows 85. The member 88 has an opening 89 formed in the center thereof to enable the member 88 to slide along the spout 14.

The member 88 has its surface 90 formed as a sector of a sphere so that a cylindrical extension 91 of a member 92, which is preferably formed of the same material as the member 87, engages the surface 90 irrespective of the position of the member 92 on the spout 14. The member 92 has its cylindrical extension 91 supported by a cylindrical extension 93 of a plate 94, which is preferably formed of a suitable metal such as stainless steel, for example. The member 92 is molded integral with the plate 94 so that the cylindrical extension 91 of the member 92 is secured to the cylindrical extension 93 of the plate 94.

The plate 94 has openings formed therein so that the member 92 has a disc 95 disposed on the opposite side of the plate 94 from the cylindrical extension 91. Thus, the member 92, the plate 94, and the disc 95 form a sealing member with the disc 95 having its flat surface 96 functioning as a sealing surface. The member 92, the plate 94, and the disc 95 have an opening 97 to enable them to be both slidably and rotatably mounted on the spout 14.

A retainer 100, which functions as a stop, is fixed to the spout 14 between the disc 95 and the discharge or free end of the spout 14 by suitable means such as a set screw, for example. The retainer 100 has a curved surface 101, preferably formed as a portion of a sphere as more particularly shown and described in the copending patent application of Donald A. Lasater for "Liquid Dispensing Nozzle Having Vapor Recovery and Sealing Arrangement," Ser. No. 581,718, filed May 29, 1975, now U.S. Pat. No. 4,003,415 and assigned to the same assignee as the assignee of this application. The disc 95 has an inner curved surface 102, preferably formed as a sphere as more particularly shown and described in the aforesaid Lasater application, engaging the curved surface 101 of the retainer 100 to form a seal therewith when the spout 14 is not inserted within the opening 15 of the fill pipe 16.

The retainer 100 has an inner flat surface 103, which is disposed inside of the surface 101. The surfaces 103 functions to lock the spout 14 within the fill pipe 16 through cooperation with a lip 104 of the fill pipe 16 as shown in FIG. 5.

Accordingly, when the spout 14 is not inserted in the opening 15 of the fill pipe 16, the annular passage 86, which is connected to the vapor recovery equipment, is not connected to the atmosphere but is sealed through the cylindrical extension 91 of the member 92 engaging the surface 90 of the member 88 and the disc 95 having its inner curved surface 102 engage the outer curved surface 101 of the retainer 100. When the spout 14 is inserted into the opening 15 (see FIG. 5) of the fill pipe 16, the outer flat surface 96 of the disc 95 abuts the end of the fill pipe 16 so as to not follow the movement of the spout 14 and the retainer 100 into the fill pipe 16. This results in the bellows 85, which continuously urges the member 88 toward the free end of the spout 14 so that the spherical surface 90 of the member 88 is always in engagement with the cylindrical extension 91 of the member 92 and the cylindrical extension 93 of the plate 94, being slightly compressed.

Accordingly, when the spout 14 is in the position of FIG. 5, vapor within the tank can flow through the opening 15 in the fill pipe 16 and the opening 89 into the annular passage 86 from which it flows to the vapor recovery equipment. Thus, the movement of the spout 14 into the fill pipe opening 15 results in the seal between the disc 95 and the retainer 100 being broken whereby the vapor can be removed from the tank being filled.

It should be understood that a spring 110 continuously urges the disc 95 into engagement with the retainer 100. The upper end of the spring 110 engages an annular sleeve 111, which has its movement limited by engaging the outlet end of the body 10. The annular sleeve 111 enables the vapors to pass between the annular sleeve 111 and the spout 14.

As previously mentioned, the poppet valve 75 is responsive to the diaphragm 70, which has one end of a spring 115 acting thereagainst. The other end of the spring 115 acts against the retainer 71. A spring 116 has one end disposed in a groove in the poppet valve 75 so that the spring 116 urges the poppet valve 75 to its closed position, but the force of the spring 116 is not as strong as the force of the spring 115, which urges the poppet valve 75 to its normally open position through a rivet in the diaphragm 70 being held against the end of the poppet valve 75 by the spring 115.

However, if the vapor pressure in the tank, which is being filled and has the fill pipe opening 15 sealed by the flat surface 96 of the disc 95 engaging the end of the fill pipe 16, increases beyond a predetermined pressure, the diaphragm 70 is moved against the force of the spring 115 to permit the poppet valve 75 to move to its closed position in response to the action of the spring 116. When this occurs, air from the opening 59 to the third passage 43 in the seat ring 26 is stopped so that the partial vacuum in the chamber 56 is increased because of the venturi effect created by the liquid flowing through the passages 40 and 41 to cause automatic closing of the main poppet valve 19. This response of the diaphragm 70 to the vapor pressure in the sealed tank is more particularly shown and described in the aforesaid Wood patent.

Considering the operation of the embodiment of FIGS. 1–5 of the present invention, the poppet valve 75 is normally in an open position as shown in FIG. 1. With the valve 75 in this position and the spout 14 disposed in the fill pipe opening 15, opening of the main poppet valve 19 by the handle 22 causes liquid to flow from the inlet 11 to the chamber 11'. The force of the spring 28 is set so that it requires a pressure differential of 2½ p.s.i. for the by-pass valve 25 to be moved to an open position to allow flow through the passage 24 in the seat ring 26.

If the poppet valve 19 is not moved sufficiently to produce this pressure differential, there would be some liquid flow through the passages 40 and 41 but this would be very slight. However, the opening of the poppet valve 19 to any extent sufficient to enable flow of liquid from the inlet 11 to the chamber 11' normally produces the necessary pressure differential to cause the by-pass valve 25 to move to an open position. When the by-pass valve 25 is moved to an open position as shown in FIG. 3, for example, liquid flows through the passage 24 in the seat ring 26 into the spout 14 from which it flows to the tank being filled.

Liquid also flows through the passages 40 and 41 in the seat ring 26 to produce the venturi effect whereby air is drawn into the passage 43 from the chamber 51. The chamber 51 draws air from the tank being filled through the opening 59 as long as the opening 59 is not blocked and the poppet valve 75 is open. When the opening 59 is blocked by the level of the liquid in the tank being filled reaching a level at which it blocks the opening 59, air can no longer be drawn through the opening 59 so that air is withdrawn from the chamber 56. This removal of air from the chamber 56 increases the partial vacuum in the chamber 56 and causes the main poppet valve 19 to be automatically closed because of the diaphragm 53 moving upwardly to cause the latch retaining pin 80 to move upwardly therewith and enable the spring 20 to close the main poppet valve 19 as more particularly shown and described in the aforesaid Wilder et al patent.

The constant areas of the passages 40 and 41 irrespective of the position to which the by-pass valve 25 is moved produce a substantially constant venturi area. Thus, because of the relatively small cross sectional areas of the passages 40 and 41, a very small flow of liquid through the nozzle body 10 fills the passages 40 and 41 with liquid so that air can be drawn only from the chamber 51 and not from the tank being filled through the spout 14 when the opening 59 is blocked or the poppet valve 75 is closed as can occur when relatively large flow areas are used in creating a venturi effect.

Referring to FIGS. 6–8, there is shown another form of the present invention including a nozzle body 120 having an inlet 121 to which a hose is connected to supply liquid such as gasoline, for example, to a chamber 122 within the interior of the body 120. The body 120 has an outlet 123 with which a spout 124 communicates to receive liquid from the chamber 122. The spout 124 has a spring 125 thereon to contact the fill pipe 16 of the vehicle tank being filled when the spout 124 is inserted within the opening 15 (see FIG. 5) in the fill pipe 16.

The spout 124 (see FIG. 6) has an end threaded in a spout adapter 127. The spout adapter 127 is connected to the outlet 123 of the body 120 by a screw 128, which is preferably formed of a material that will break or shear when subjected to a predetermined force. Thus, if the spout 124 should be retained in a vehicle tank when the vehicle is moved, the screw 128 breaks or shears and allows the spout adapter 127 to be pulled from the body 120 without any damage to the body 120 or to the pump to which the body 120 is connected by a hose.

The body 120 has a first or main poppet valve 129 supported therein for control of the flow of liquid from the inlet 121 to the chamber 122 within the interior of the body 120 and from the chamber 122 to the outlet 123 of the body 120. A spring 130 continuously urges the poppet valve 129 to its closed position in which flow from the inlet 121 to the chamber 122 and the outlet 123 is stopped or prevented.

A stem 131 is connected to the poppet valve 129 and has its lower portion extending exteriorly of the body 10. The valve stem 131, which is slidably disposed within the body 10, is moved by a manually operated lever or handle 132. The stem 131 passes through the body 120 in the same manner as described in U.S. Pat. No. 3,653,415 to Boudot et al.

A by-pass or bleeder poppet valve 133, which has a conical shape, is slidably mounted within a passage 134 in a seat ring 136. The seat ring 136 is secured to the spout adapter 127 by being threadedly connected thereto as shown in FIGS. 7 and 8 and has a sealing ring 137 disposed between the body 120 and the seat ring 136 to prevent leakage therebetween.

A spring 138, which has one end engaging a portion of the spout adapter 127 and its other end engaging a flat surface 139 of the by-pass valve 133, urges the by-pass valve 133 to the position in FIG. 7 in which outer surface or wall 140 of the by-pass valve 131 engages an angled wall 141 of the passage 134 in the seat ring 126. Thus, only the pressure of the liquid going from the inlet 121 and past the main poppet valve 129 can overcome the spring 138 and move the by-pass valve 133 to an open position (see FIG. 8).

The by-pass valve 133 has a first passage 145 having one end communicating with the chamber 122 within the interior of the body 120 and its other end communicating with one end of a second passage 146 in the valve 133. The other end of the second passage 146 communicates with the downstream sides of the seat ring 136 and the valve 133 irrespective of whether the valve 133 is opened or closed.

The first passage 145 has a smaller diameter than the second passage 146 to form a shoulder 147 at the junction of the first passage 145 and the second passage 146. The valve 133 has a third passage 148, which has its axis substantially perpendicular to the passages 145 and 146 and has a slightly smaller diameter than the first passage 145, communicating with the second passage 146 and a fourth passage 149, which has the same diameter as the third passage 148, in a longitudinally extending portion 150 of the valve 133.

The longitudinally extending portion 150 of the by-pass valve 133 is slidably disposed in a cylindrical extension 151 of the spout adapter 127. The cylindrical extension 151 is hollow so as to have a passage 152 therein communicating with the fourth passage 149 in the longitudinally extending portion 150 of the by-pass valve 133. The cylindrical extension 151 has the spring 138 disposed therearound.

The passage 152 communicates with a second passage 153 in the spout adapter 127. The second passage 153 communicates through a chamber 154, which is formed between the spout adapter 127 and the body 120, a passage 156 in the body 120, an opening in a diaphragm 157, and a passage 158 in a cap 159 to a chamber 160, which is formed between the diaphragm 157 and the cap 159.

A sealing ring 161 is disposed between the spout adapter 127 and the body 120. The sealing rings 137 and 161 prevent air from entering the chamber 154 from exterior of the body 120.

The passage 152 in the cylindrical extension 151 of the spout adapter 127 also communicates with a vacuum tube 162, which is connected with an opening 163 in the spout 124 adjacent the discharge or free end of the spout 124. Thus, the third passage 148 in the by-pass valve 133 communicates with both the chamber 160 and the vacuum tube 162.

As liquid flows through the first passage 145 in the by-pass valve 133 and the second passage 146 in the by-pass valve 133, a venturi effect is created in the third passage 148 in the by-pass valve 133. This is because the increase in the cross sectional area of the second passage 146 compared with the cross sectional area of the first passage 145 produces an expansion of the liquid to reduce its velocity whereby the pressure in the second passage 146 decreases so that air is drawn from the third passage 148.

As long as the opening 163 in the spout 124 is not closed due to the liquid within the tank reaching a predetermined level that indicates the tank is filled, the venturi effect created by the flow of the liquid through the passages 145 and 146 in the by-pass valve 133 draws air through the tube 162 to create a partial vacuum within the chamber 160. However, as soon as the opening 163 in the vacuum tube 162 is blocked, the chamber 160 has its pressure reduced due to the air therein being drawn therefrom because of the venturi effect in the third passage 148 due to the liquid flowing through the passages 145 and 146 whereby the diaphragm 157 moves upwardly since the partial vacuum in the chamber 160 is increased.

The diaphragm 157 has a latch retaining pin 170 secured thereto for movement therewith and disposed between three balls 171 (two shown), which are positioned within passages in a latch plunger 172. When the latch retaining pin 170 is in the position shown in FIG. 1, the balls 171 prevent downward movement of the plunger 172, which is slidably mounted within the body 120.

When the diaphragm 157 is moved upwardly due to the increase in the partial vacuum in the chamber 160, the latch retaining pin 170 is moved upwardly therewith. The upward movement of the retaining pin 170 disposes a tapered portion of the retaining pin 170 between the balls 171 whereby the balls 171 may move inwardly to allow the plunger 172 to be moved downwardly against the force of its spring 173. The correlation between the tapered portion of the pin 170 and the latch plunger 172 is more specifically shown in the aforesaid Duerr patent.

The lower end of the plunger 172 is connected to the handle 132 as more particularly shown and described in the aforesaid Wilder et al patent. Thus, when the diaphragm 157 moves upwardly to pull the latch retaining pin 170 and release the latch plunger 172 from the balls 171, the force of the spring 130 closes the main poppet valve 129 as more particularly shown and described in the aforesaid Wilder et al patent.

Considering the operation of the modification of FIGS. 6–8 of the present invention, the spout 124 is disposed in the fill pipe opening 15 (see FIG. 5) and the main poppet valve 129 is opened by the handle 132 to cause liquid to flow from the inlet 121 to the chamber 122. The force of the spring 138 is set so that it requires a pressure differential of 2½ p.s.i. for the by-pass valve 133 to be moved to an open position to allow flow through the passage 134 in the seat ring 126.

If the poppet valve 129 is not moved sufficiently to produce this pressure differential, there would be some liquid flow through the passages 145 and 146 but this would be very slight. However, the opening of the poppet valve 129 to any extent sufficient to enable flow of liquid from the inlet 121 to the chamber 122 normally produces the necessary pressure differential to cause the by-pass valve 133 to move to an open position. When the by-pass valve 133 is moved to an open position as shown in FIG. 8, for example, liquid flows through the passage 134 in the seat ring 136 into the spout 124 from which it flows to the tank being filled.

Liquid also flows through the passages 145 and 146 in the by-pass valve 133 to produce the venturi effect whereby air is drawn into the third passage 148 in the valve 133 from the passage 152 in the cylindrical extension 151 of the spout adapter 127. The passage 152 draws air from the tank being filled through the opening 163 in the spout 124 as long as the opening 163 is not blocked. When the opening 163 in the spout 124 is blocked by the level of liquid in the tank reaching a level at which it blocks the opening 163, air can no longer be drawn through the opening 163 so that air is withdrawn from the chamber 160. This removal of air from the chamber 160 increases the partial vacuum therein and causes the main poppet valve 129 to be automatically closed because of the diaphragm 157 moving upwardly to cause the latch retaining pin 170 to move upwardly therewith and enable the spring 130 to close the main poppet valve 129 as more particularly shown and described in the aforesaid Wilder et al patent.

In the same manner as described with respect to the embodiment of FIGS. 1–5, the constant areas of the passages 145 and 146 irrespective of the position to which the by-pass valve 133 is moved produce a substantially constant venturi effect. Thus, because of the relatively small cross sectional areas of the passages 145 and 146, a very small flow of liquid through the nozzle body 120 fills the passages 145 and 146 with liquid so that air can be drawn only from the passage 152 in the extension 151 of the spout adapter 127 and not from the tank through the spout 124 when the opening 163 in the spout 124 is blocked. This can occur when relatively large flow areas are used in creating a venturi effect.

It should be understood that the venturi arrangement of FIGS. 1–5 could be employed with the nozzle of FIGS. 6–8. It would be necessary to replace the seat ring 136 and the by-pass valve 133 with the seat ring 26 and the by-pass valve 25 of FIGS. 1–4. It would be necessary to eliminate the passage 152 communicating with the vacuum tube 162 and the second passage 153 in the spout adapter 127. It also would be necessary to insure that the third passage 43 in the seat ring 26 communicates with the chamber 154.

While the modification of FIGS. 1–5 has shown the seat ring 26 as having only the single venturi, it should be understood that the seat ring 26 could have a plurality of the passages 40 and 41 with each communicating through its own third passage 43 with the chamber 51. This would provide an increased flow area for the venturi effect if desired. However, as previously mentioned, it is necessary to maintain the flow areas for the venturi constant and relatively small to insure that the venturi effect is created at relatively low flow rates.

With the venturi arrangements of the present invention there is a reduction in the amount of foaming within the nozzle during liquid flow therethrough. This is because the relatively small flow areas of the venturi draw less air than is obtained with the previously available venturi arrangements having a variable flow area. This reduction in the amount of air drawn into the venturi prevents premature cut off.

An advantage of this invention is that automatic shut off of flow through a nozzle is obtained when the flow rate is relatively low such as ¼ to ½ gallon per minute. Another advantage of this invention is that it eliminates the hazard of gasoline spilling from a tank because of the automatic shut-off mechanism failing to function at relatively low flow rates. A further advantage of this invention is that it prevents an attendant from deceiving a customer into paying for gasoline not retained in the vehicle tank but returned to the supply tank through the vapor recovery arrangement. Still another advantage of this invention is that foaming in the nozzle is reduced.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An automatic shut-off nozzle comprising a body having an inlet, an outlet, and a first chamber between said inlet and said outlet, a first valve in said body controlling flow of liquid from said inlet to said first chamber, manual operated means controlling the operation of said first valve, a second valve in said body controlling flow of liquid from said first chamber to said outlet in accordance with the pressure differential therebetween, a seat ring in said body to support said second valve for movement relative thereto, spout means communicating with said outlet and having its free end disposed for disposition in an opening of a fill pipe of a vehicle tank or the like, a second chamber, first communicating means communicating said second chamber with the tank, one of said second valve and said seat ring having second communicating means therein to permit liquid flow therethrough from said first chamber to said outlet irrespective of whether said second valve is open or closed, said second communicating means having an inlet communicating with said first chamber downstream of said first valve and upstream of said second valve and said seat ring and an outlet communicating with said outlet of said body downstream of said second valve and said seat ring, said inlet of said second communicating means having a fixed area, said outlet of said second communicating means having a fixed area, said second communicating means having means intermediate said inlet of said second communicating means and said outlet of said second communicating means communicating with said second chamber to create a partial vacuum in said second chamber when liquid flows through said second communicating means and said first communicating means communicates with the tank, said second communicating means increasing the partial vacuum in said second chamber when liquid flows through said second communicating means and communication of said first communicating means with the tank is blocked, and means responsive to the increased partial vacuum in said second chamber to cause closing of said first valve.

2. The nozzle according to claim 1 in which said second communicating means includes first and second passages in the one of said second valve and said seat ring having said second communicating means, said first passage having one end communicating with said first chamber to form said inlet of said second communicating means and its other end communicating with one end of said second passage, said second passage having its other end communicating with said outlet of said body to form said outlet of said second communicating means, said first passage having a substantially constant cross sectional area, said second passage having a substantially constant cross sectional area and larger than the cross sectional area of said first passage, and said intermediate means of said second communicating means provides communication of said second passage with said second chamber.

3. The nozzle according to claim 2 in which said second valve has said second communicating means.

4. The nozzle according to claim 3 in which said intermediate means of said second communicating means comprises passage means in said second valve connecting said second passage of said second communicating means with said first communicating means.

5. The nozzle according to claim 2 in which said seat ring has said second communicating means.

6. The nozzle according to claim 5 in which said intermediate means of said second communicating means comprises passage means in said seat ring connecting said second passage of said second communicating means with said first communicating means.

7. The nozzle according to claim 2 in which said intermediate means of said second communicating means comprises passage means connecting said second passage of said second communicating means with said first communicating means.

8. The nozzle according to claim 1 in which said intermediate means of said second communicating means provides communication only between said second communicating means and said first communicating means to provide communication of said second communicating means with said second chamber.

9. The nozzle according to claim 1 in which said second valve has said second communicating means.

10. The nozzle according to claim 1 in which said seat ring has said second communicating means.

* * * * *